US012439988B2

(12) United States Patent
Zimmer

(10) Patent No.: US 12,439,988 B2
(45) Date of Patent: Oct. 14, 2025

(54) HELMET SHROUD ASSEMBLY

(71) Applicant: Trent Zimmer, Youngsville, LA (US)

(72) Inventor: Trent Zimmer, Youngsville, LA (US)

(73) Assignee: Division Group, LLC

( * ) Notice: Subject to any disclaimer, the term of this patent is extended or adjusted under 35 U.S.C. 154(b) by 0 days.

(21) Appl. No.: 18/524,288

(22) Filed: Nov. 30, 2023

(65) Prior Publication Data

US 2024/0172829 A1 May 30, 2024

Related U.S. Application Data

(60) Provisional application No. 63/429,107, filed on Nov. 30, 2022.

(51) Int. Cl.
*A42B 3/04* (2006.01)

(52) U.S. Cl.
CPC ..... *A42B 3/0406* (2013.01); *A42B 3/04* (2013.01); *A42B 3/042* (2013.01); *A42B 3/044* (2013.01)

(58) Field of Classification Search
CPC ..... A42B 3/0406; A42B 3/042; A42B 3/044; A42B 3/04
USPC ..... 2/422
See application file for complete search history.

(56) References Cited

U.S. PATENT DOCUMENTS 6,751,810 B1 6/2004 Prendergast
7,004,439 B1 * 2/2006 Taylor ..... F21V 21/084 248/548
8,338,703 B2 * 12/2012 Crohas ..... H04M 1/0214 439/535
9,414,633 B2 * 8/2016 Giroux Bernier ..... A42B 3/221
9,631,899 B2 * 4/2017 Lebel ..... A42B 3/04
9,775,395 B2 10/2017 Teetzel et al.
10,264,840 B2 4/2019 Teetzel et al.
11,229,252 B2 1/2022 O'Connell
11,363,850 B2 * 6/2022 Vilone ..... A42B 3/04
11,382,375 B2 7/2022 Noordzij et al.
2011/0145981 A1 6/2011 Teetzel et al.
2011/0170280 A1 * 7/2011 Soto ..... A42B 3/044 362/105
2015/0282549 A1 * 10/2015 Lebel ..... A42B 3/04 2/422
2016/0212869 A1 * 7/2016 Gutschenritter ..... A42B 3/0406
(Continued)

FOREIGN PATENT DOCUMENTS

WO WO-2009142797 A2 * 11/2009 ..... A42B 3/042

*Primary Examiner* — Taylor Morris
(74) *Attorney, Agent, or Firm* — Asgaard Patent Services, LLC; F. Wayne Thompson, Jr.

(57) ABSTRACT

The shroud assembly is configured for attachment to the front of a helmet or other headgear. The shroud assembly includes an interface for the removable attachment of an accessory mount used to couple an electronic or optoelectronic imaging device to the headgear. An example shroud assembly comprises a polymer frame and an insert formed of a metal or metal alloy. The polymer frame is overmolded onto the insert such that the polymer frame and the insert cooperate to form an interface for the removable attachment of an accessory mount. The interface includes an upper recess and a lower recess. The upper recess is configured to act as a bearing surface for an engaging latch member of the accessory mount, and the lower recess is configured to act as a bearing surface for another engaging latch member of the accessory mount.

20 Claims, 14 Drawing Sheets

(56) References Cited

U.S. PATENT DOCUMENTS

| | | | | |
|---|---|---|---|---|
| 2017/0049176 | A1* | 2/2017 | Giroux Bernier | A42B 3/04 |
| 2019/0104797 | A1* | 4/2019 | Teetzel | F41H 1/04 |
| 2019/0107247 | A1* | 4/2019 | Teetzel | F16B 47/003 |
| 2020/0000167 | A1* | 1/2020 | Noordzij | A42B 3/044 |
| 2020/0260812 | A1* | 8/2020 | Langlois | A42B 3/04 |
| 2020/0288806 | A1* | 9/2020 | Vilone | G03B 17/561 |
| 2021/0244120 | A1* | 8/2021 | Meney | F16M 13/04 |
| 2021/0244122 | A1 | 8/2021 | O'Connell | |
| 2022/0202126 | A1 | 6/2022 | Teetzel | |
| 2022/0264985 | A1* | 8/2022 | Rietdyk | F16M 13/04 |
| 2022/0378141 | A1* | 12/2022 | Bischofberger | A42B 3/28 |
| 2024/0407493 | A1* | 12/2024 | Teetzel | A42B 3/04 |

* cited by examiner

HELMET SHROUD ASSEMBLY

CROSS-REFERENCE TO RELATED APPLICATION(S)

This application claims the benefit of U.S. Provisional Application Ser. No. 63/429,107, filed on Nov. 30, 2022, the entirety of which is incorporated herein by reference.

TECHNICAL FIELD

This disclosure relates to a shroud assembly configured for attachment to a helmet or other headgear.

BACKGROUND

Helmets are worn to protect against head injuries in various settings, including recreational activities like rock climbing and professional contexts such as military or police use. It is often desirable to mount an accessory device on the helmet, such as a night vision device, camera, or other electronic or optoelectronic imaging device. A shroud is often affixed to the front of the helmet, and used in tandem with an accessory mount to facilitate the attachment of the accessory device, which may be moveable between stowed and in-use positions. Frequently, the shroud is positioned to allow the attached accessory device to be placed in front of the user's eyes.

Accordingly, needs exist for the helmet shroud assembly disclosed herein. It is to the provision of a helmet shroud assembly configured to address these needs, and others, that the present invention is primarily directed.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed is a shroud assembly configured for attachment to the front of a helmet or other headgear. The shroud assembly includes an interface for the removable attachment of an accessory mount used to couple an electronic or optoelectronic imaging device to the headgear.

An example shroud assembly comprises a polymer frame and an insert formed of a metal or metal alloy. The polymer frame is overmolded onto the insert such that the polymer frame and the insert cooperate to form an interface for the removable attachment of an accessory mount. The interface includes an upper recess and a lower recess. The upper recess is configured to act as a bearing surface for an engaging latch member of the accessory mount, and the lower recess is configured to act as a bearing surface for another engaging latch member of the accessory mount.

Another example shroud assembly comprises a polymer frame and an insert formed of a metal or metal alloy. The polymer frame is overmolded onto the insert. The polymer frame and the insert cooperate to form an interface for the removable attachment of an accessory mount. The interface includes an upper recess and a lower recess. The upper recess and the lower recess each include an interior-facing sidewall that is an exposed portion of the insert not covered by the polymer frame.

Yet another example shroud assembly comprises a metal alloy insert and a polymer frame overmolded onto the insert. An accessory mount interface is formed by the metal alloy insert and the polymer frame. The accessory mount interface includes an upper recess, in which a first interior-facing sidewall of the metal alloy insert is exposed, and a lower recess, in which a second interior-facing sidewall of the metal alloy insert is exposed.

BRIEF DESCRIPTION OF THE DRAWINGS

Like reference numerals refer to corresponding parts throughout the several views of the drawings.

DETAILED DESCRIPTION

Figure 10:
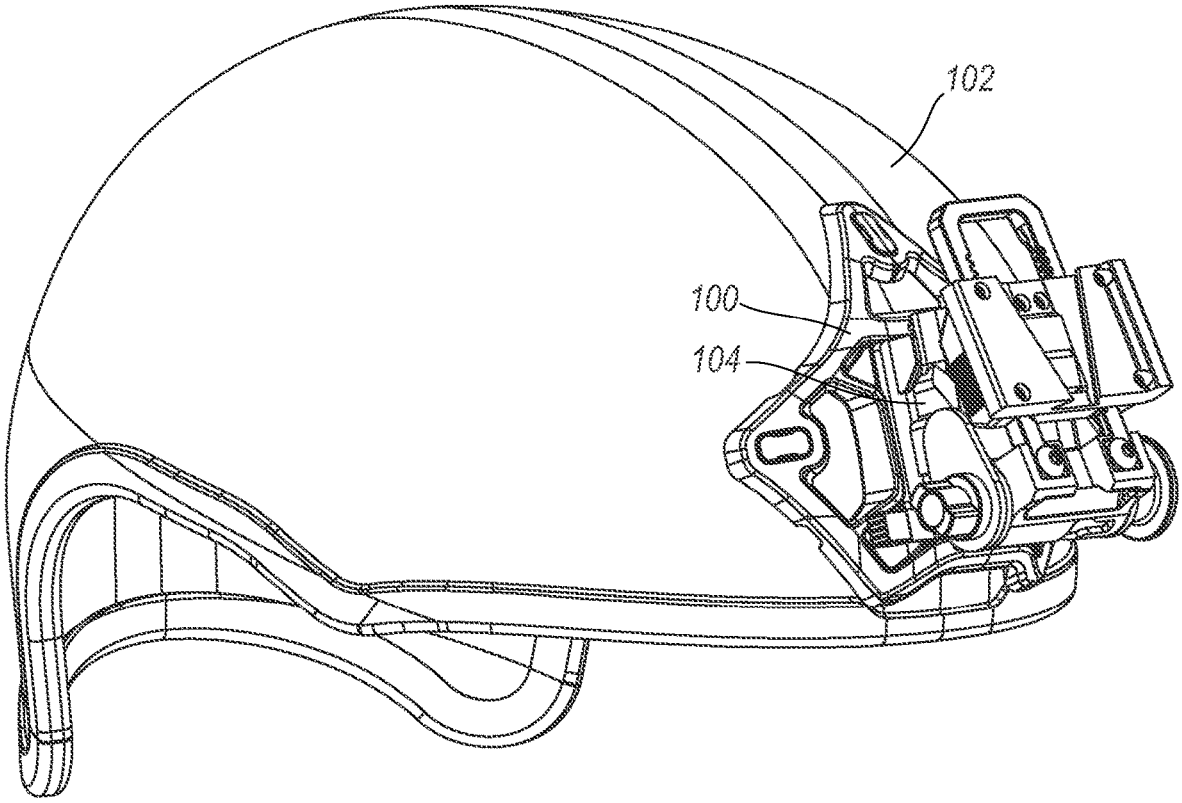
FIG. 10 is an isometric view of the shroud assembly, shown in FIG. 1, secured to the front of a helmet, with an accessory mount attached to the shroud assembly.
Figure 11:
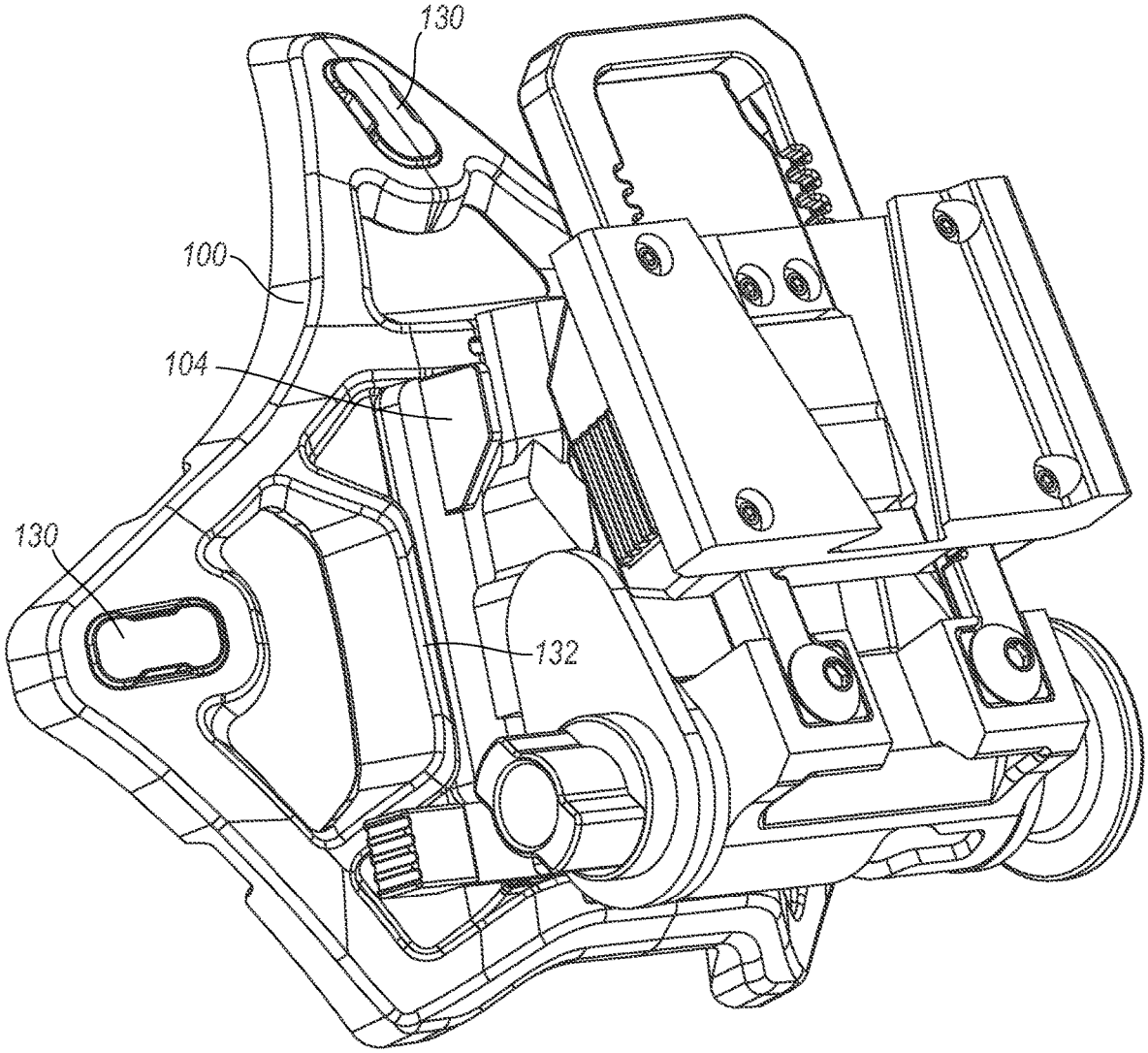
FIG. 11 is an isometric view of the shroud assembly and attached accessory mount shown in FIG. 10, wherein the helmet has been omitted.

FIGS. 1-5 illustrate an example shroud assembly 100 according to the principles of the present disclosure. As shown in FIG. 10, the shroud assembly 100 is configured for attachment to the front of a helmet 102 and includes an interface 108 for the removable attachment of an accessory mount 104 used to couple a night vision device to the helmet 102. While the shroud assembly 100 is described primarily by way of reference to use with night vision devices, the present shroud assembly 100 can be used to couple monocular and binocular devices, including optical viewing devices, thermal cameras, or other electronic or optoelectronic imaging devices to the helmet 102.

Example accessory mounts that can be attached to the interface 108 of the shroud assembly 100 are the Wilcox Industries Corp. G11 and G24 mounts, well known to those of ordinary skill in the art. However, the shroud assembly 100 could be adapted for use with other accessory mounts by providing an interface 108 which has retention features complimentary with a desired accessory mount.

As shown in FIGS. 2-5, the shroud assembly 100 comprises a polymer frame 110 and a metal or metal alloy insert 112, indicated by broken lines. The shroud assembly 100 is formed by overmolding the frame 110 to the insert 112, thereby making the shroud assembly 100 a unitary piece. This results in a shroud assembly 100 having a superior strength-to-weight ratio when compared to prior art shrouds. More specifically, in some implementations, the shroud assembly 100 may achieve a weight reduction of more than 25% compared to prior art shrouds. The frame 110 has a generally concave back surface 114 which is shaped to generally conform to the shape of a selected helmet, or other headgear. The frame 110 is also flexible such that the shroud assembly 100 can adapt to the exterior surface of the selected helmet to which the shroud assembly 100 is coupled. While the frame 110 of the shroud assembly 100 is flexible, the insert 112 is a rigid stiffening element that provides additional strength and rigidity to the interface 108.

The frame 110 is formed of a nylon material that is overmolded around the insert 112, leaving portions of the insert 112 uncovered. The frame 110 is of a generally triangular construction and includes an opening 128 in each of the three corners. The three openings 128 in the frame 110 are arranged so the shroud assembly 100 can be attached to a helmet having a three-hole pattern, such as the standard MARSOC/WARCOM three-hole pattern. Each opening 128 is a slot configured to receive a fastener (e.g., a bolt or other suitable anchor) used to secure the shroud assembly 100 to the selected helmet.

While the shroud assembly 110 is configured for attachment to a helmet having the standard three-hole pattern, the shroud assembly 100 can also be secured to a helmet 102 using an adhesive (e.g., an epoxy adhesive, a double-sided acrylic foam tape, or other suitable adhesive). Accordingly, the shroud assembly 100 may also include plugs 130 used to fill each of the openings 128 in the frame 110. Each plug 130 is configured to be snap-fit within a corresponding opening 128, thereby sealing it. When using an adhesive to secure the shroud assembly 100 to a selected helmet 102, cavities 134 in the back surface 114 of the frame 110 are filled with the adhesive. The shroud assembly 100 is then clamped to the helmet 102 until the adhesive cures. It should be noted that each plug 130 also includes a cavity 136 that can be filled with adhesive used to secure the shroud assembly 100 to the helmet 102 (see, e.g., FIG. 5).

The insert 112 is preferably formed by stamping, although metal injection molding and additive manufacturing (i.e., 3D printing) are also contemplated. The insert 112 is preferably formed of a stainless steel. The preferred implementation of the insert 112 is a unitary piece. However, in other implementations, the insert 112 could be two or more pieces.

Figure 1:
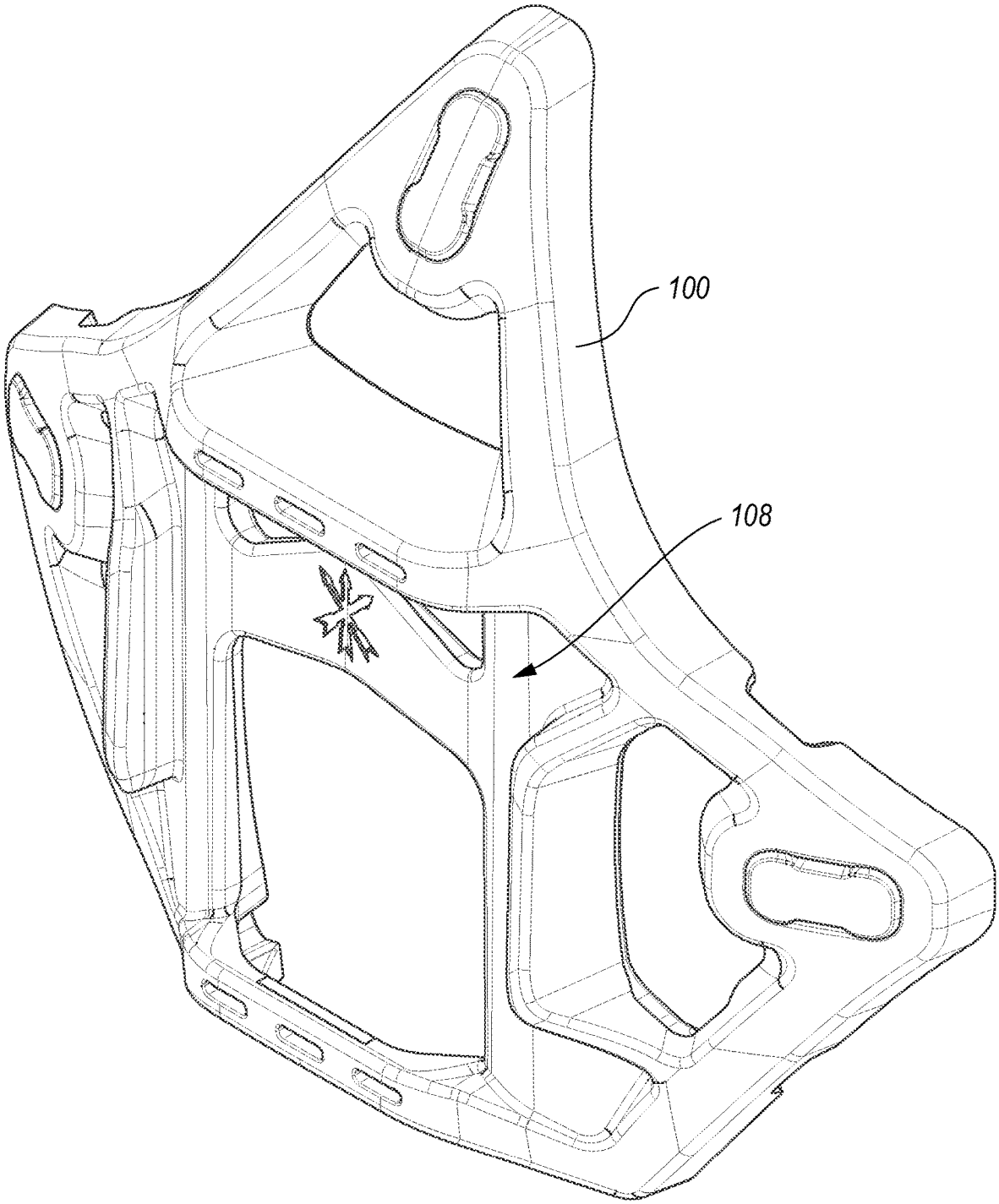
FIG. 1 is an isometric view of a shroud assembly according to the principles of the present disclosure.
Figure 2:
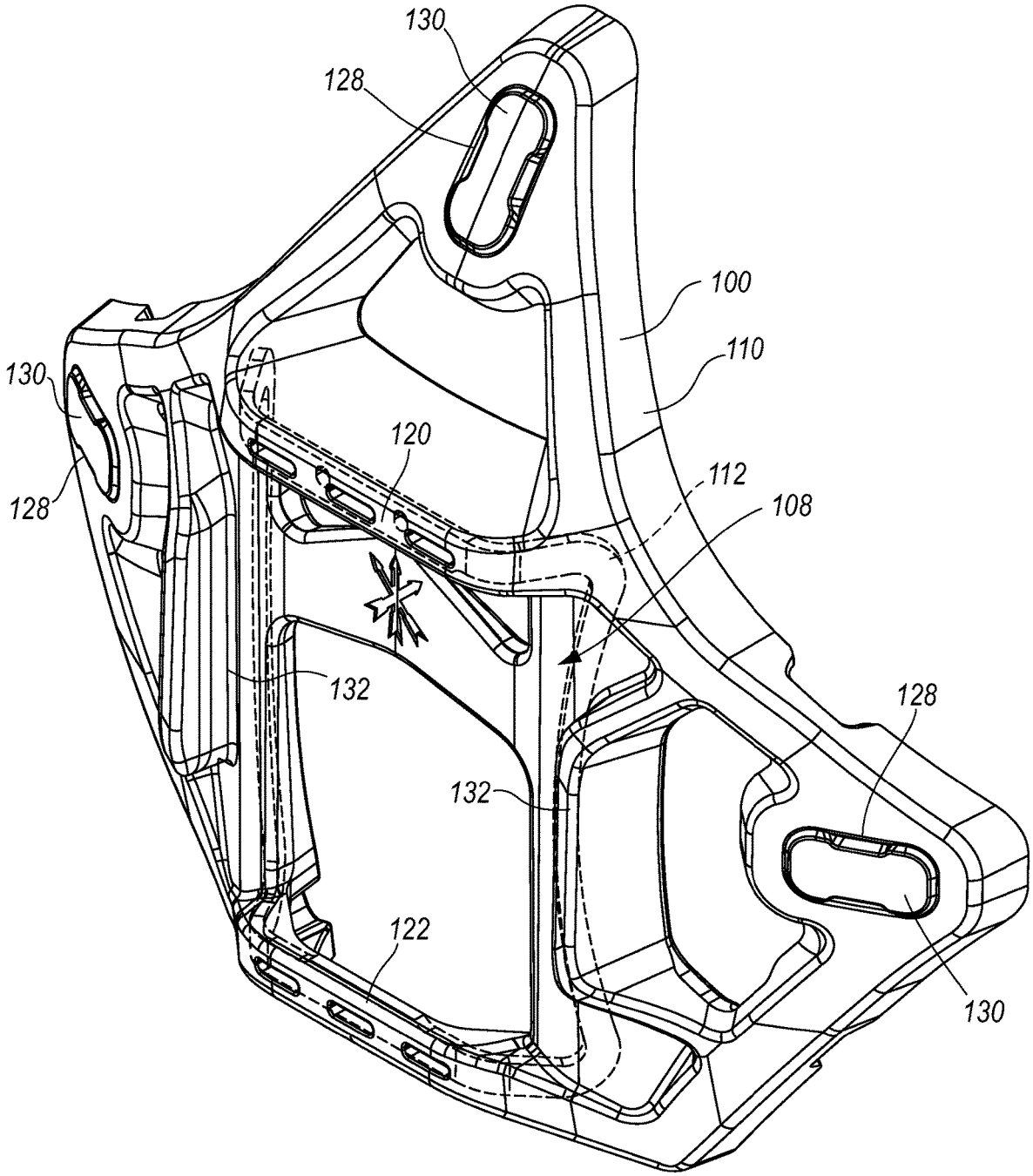
FIG. 2 is an isometric view of the shroud assembly shown in FIG. 1, wherein the insert of the shroud assembly is shown in broken lines.
Figure 3:
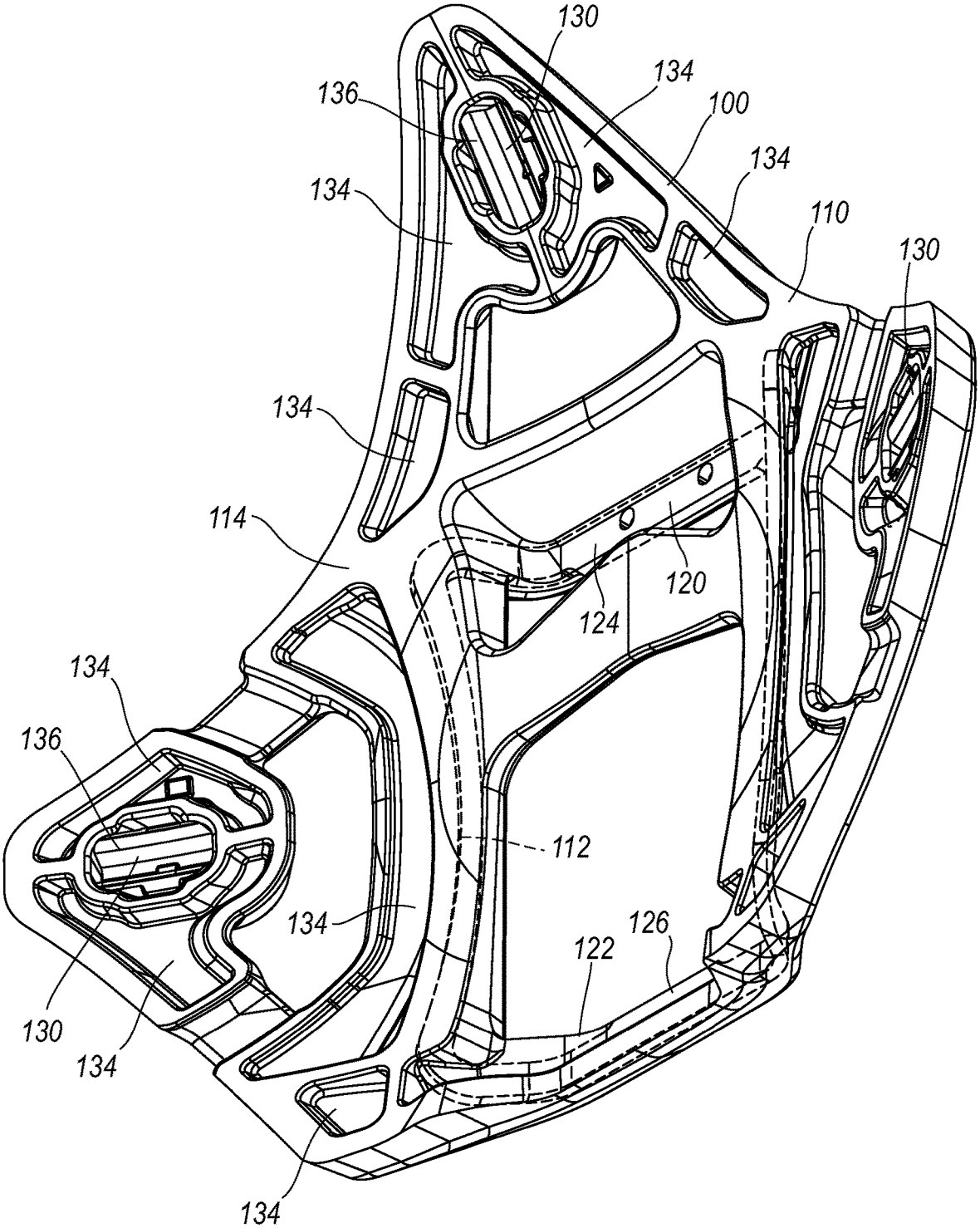
FIG. 3 is another isometric view of the shroud assembly shown in FIG. 2.
Figure 4:
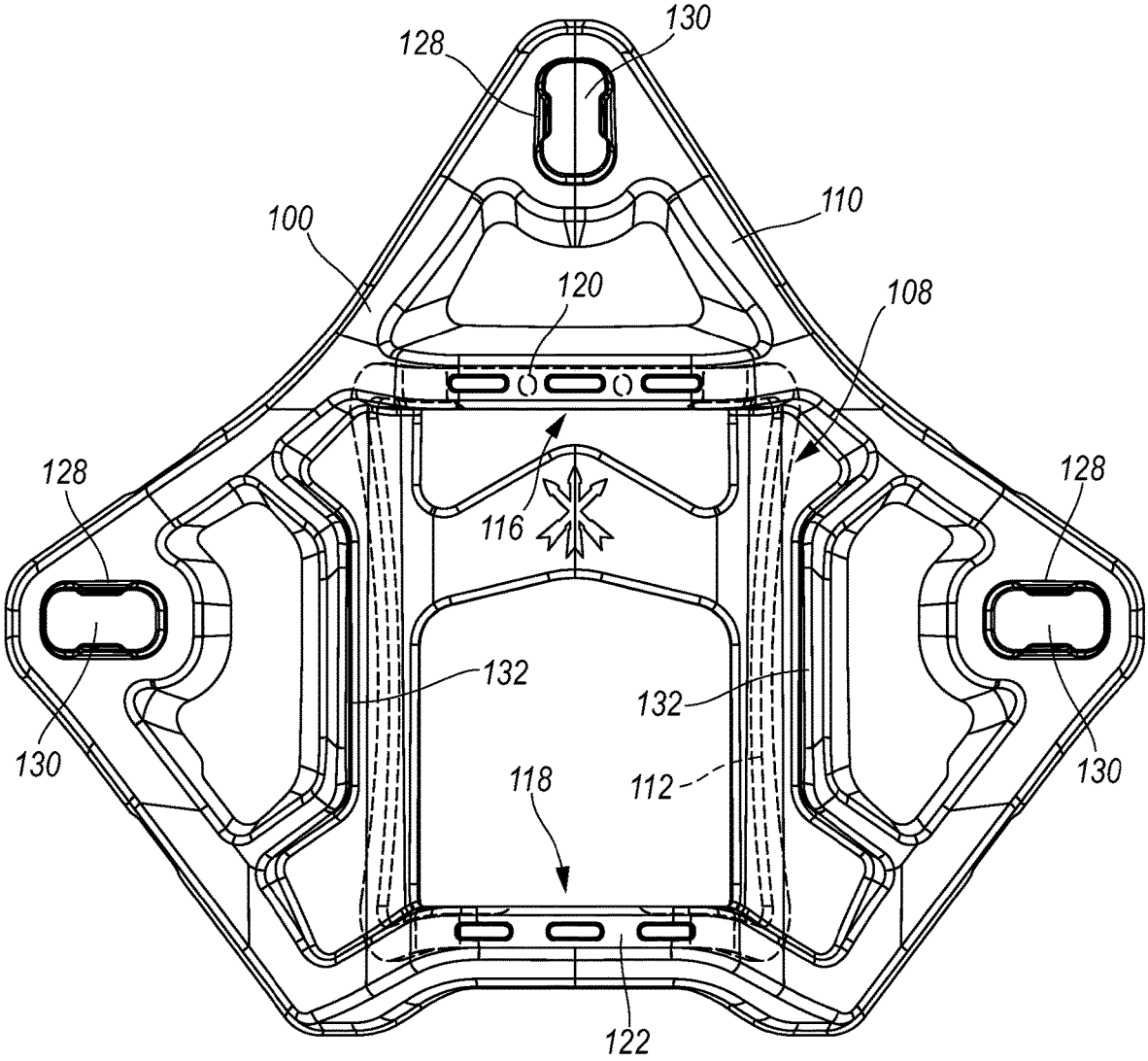
FIG. 4 is a front elevational view of the shroud assembly shown in FIG. 2.
Figure 5:
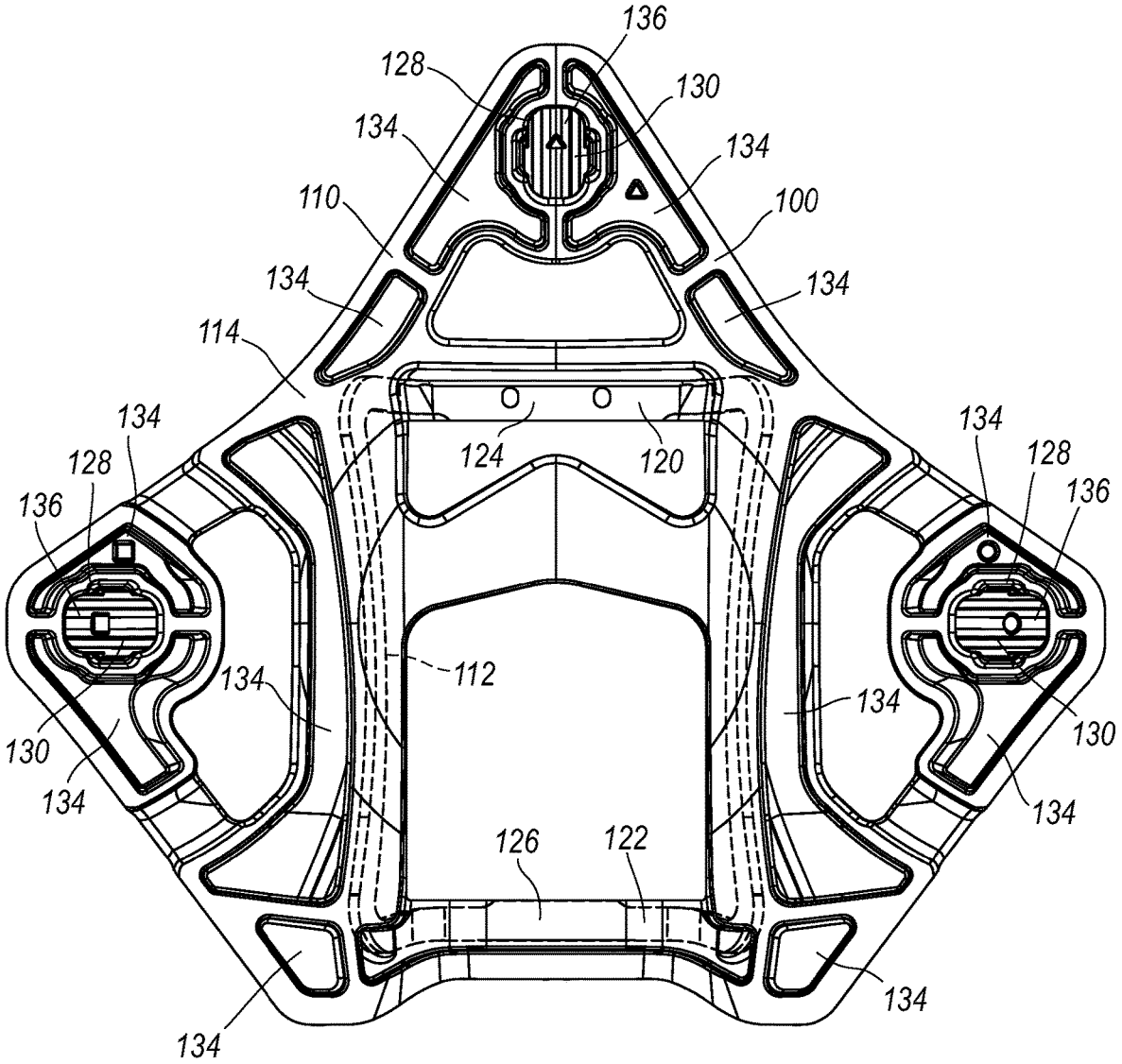
FIG. 5 is a back elevational view of the shroud assembly shown in FIG. 2.
Figure 6:
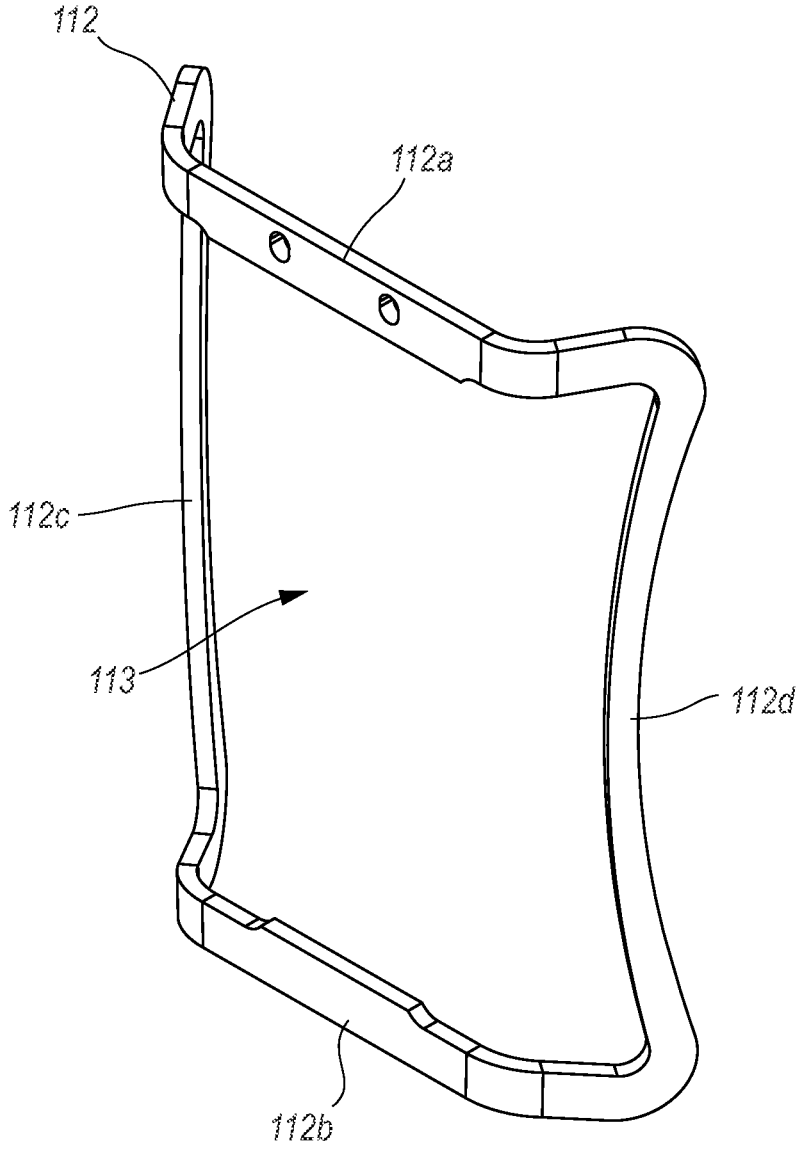
FIG. 6 is an isometric view of the insert shown in FIG. 2.
Figure 7:
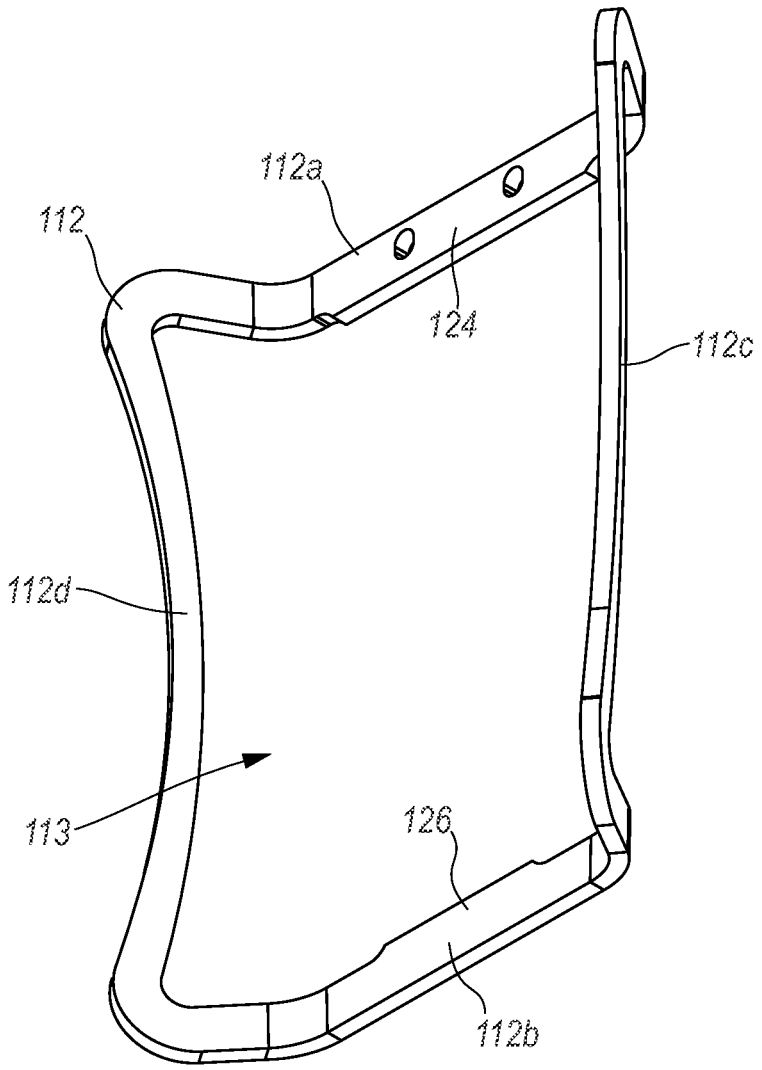
FIG. 7 is another isometric view of the insert shown in FIG. 6.
Figure 8:
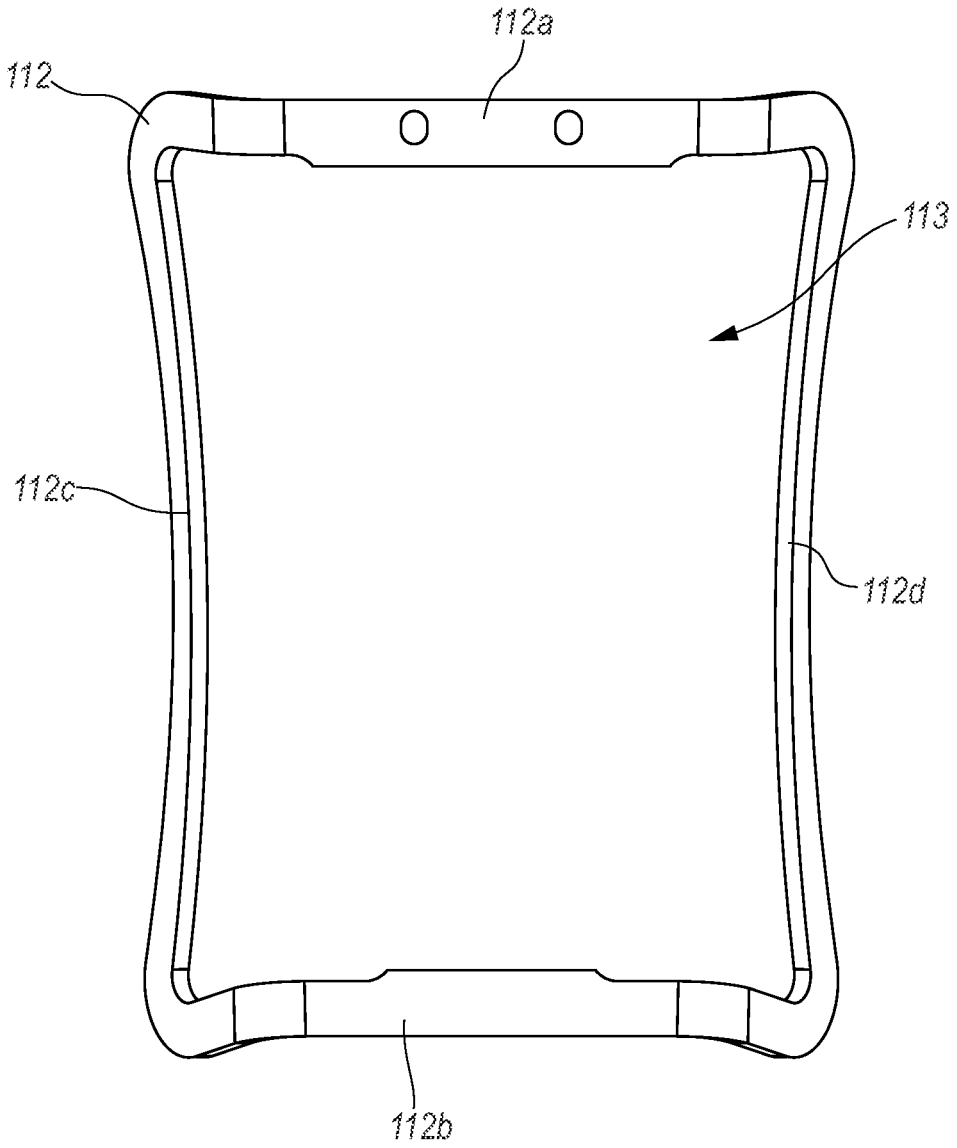
FIG. 8 is a front elevational view of the insert shown in FIG. 6.
Figure 9:
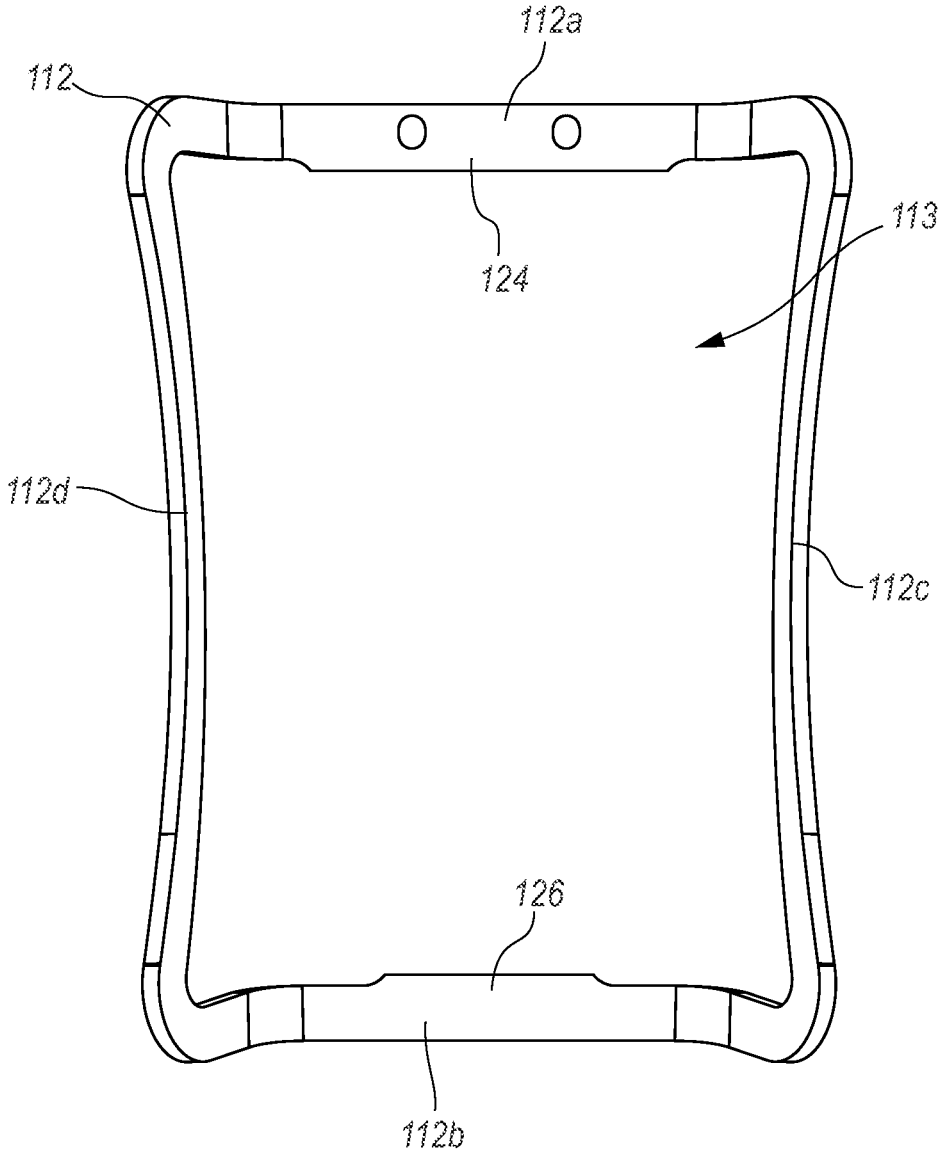
FIG. 9 is a back elevational view of the insert shown in FIG. 6.

As shown best in FIGS. 6-9, the insert 112 comprises a top crossmember 112*a*, a bottom crossmember 112*b*, and two side posts (112*c*, 112*d*) interconnecting the crossmembers (112*a*, 112*b*). The top crossmember 112*a* and bottom crossmember 112*b* are horizontally oriented and structurally connected by the vertically aligned side posts (112*c*, 112*d*), collectively delineating the boundaries of a central opening 113. In some implementations, each side post (112*c*, 112*d*) may have an arcuate length. As seen in FIGS. 2 and 6, the top crossmember 112*a* and bottom crossmember 112*b* are positioned in an offset manner, situated forward of the side posts (112*c*, 112*d*).

Figure 12:
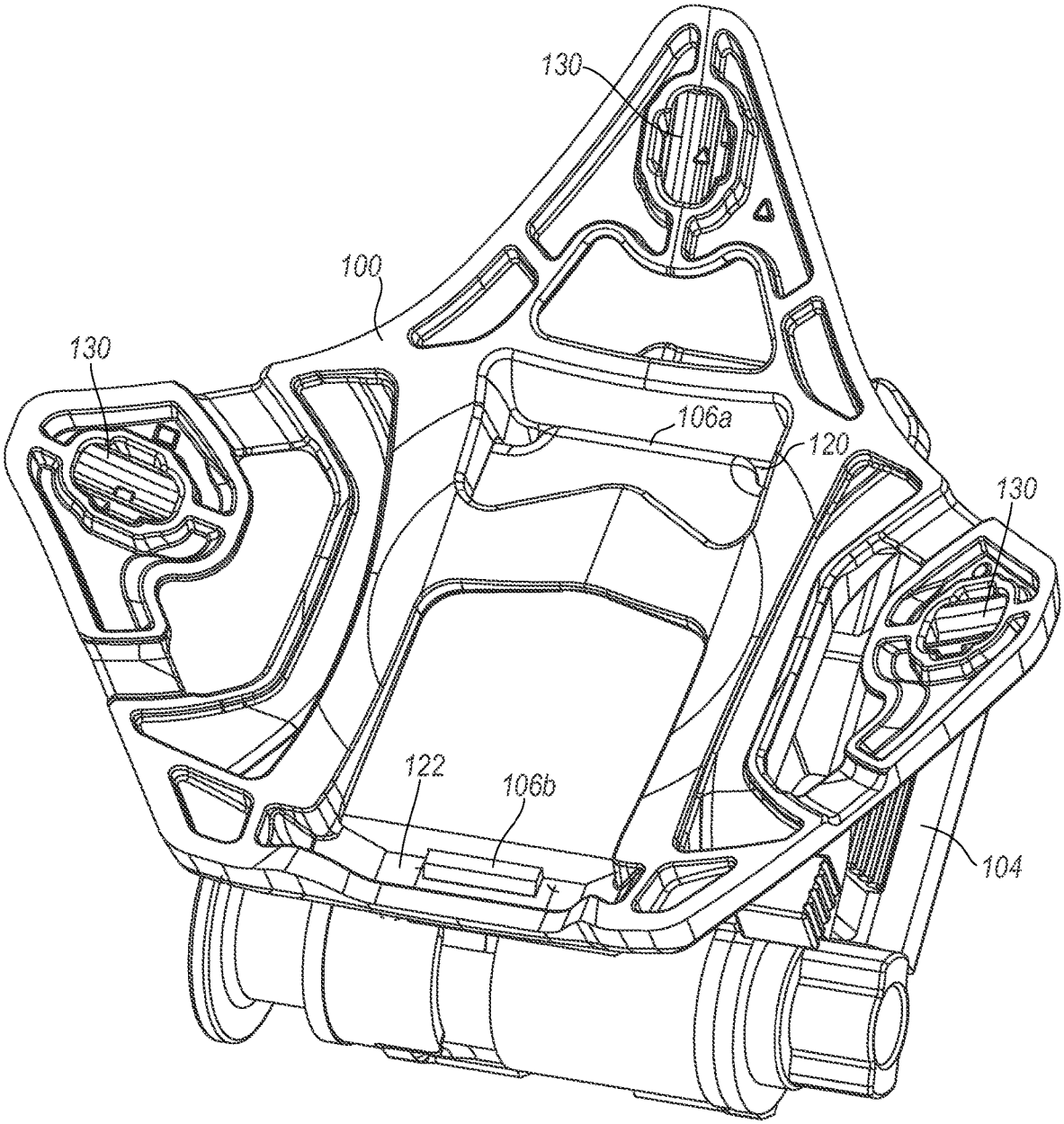
FIG. 12 is another isometric view of the shroud assembly and attached accessory mount shown in FIG. 11.
Figure 13:
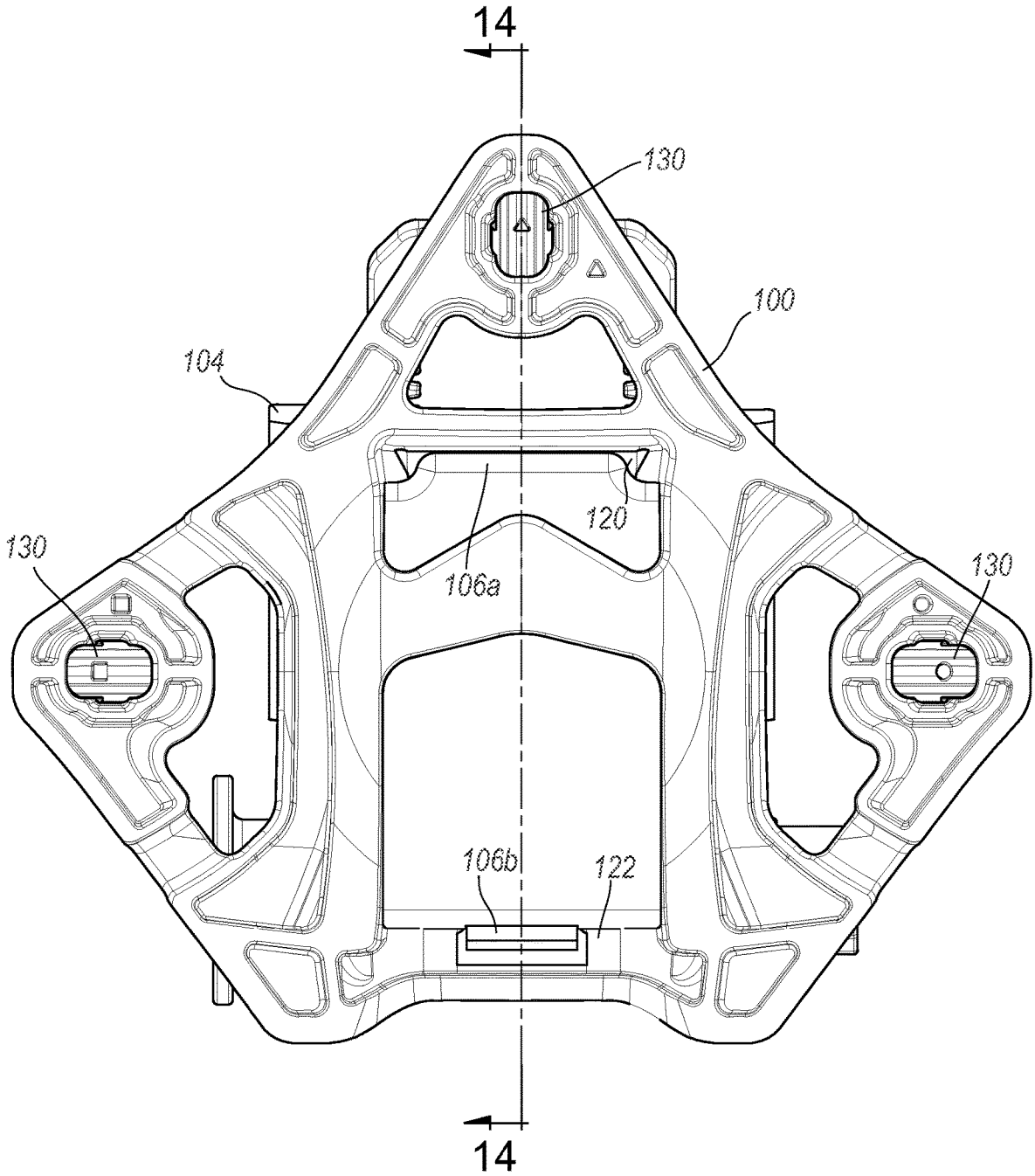
FIG. 13 is a rear elevational view of the shroud assembly and attached accessory mount shown in FIG. 11.
Figure 14:
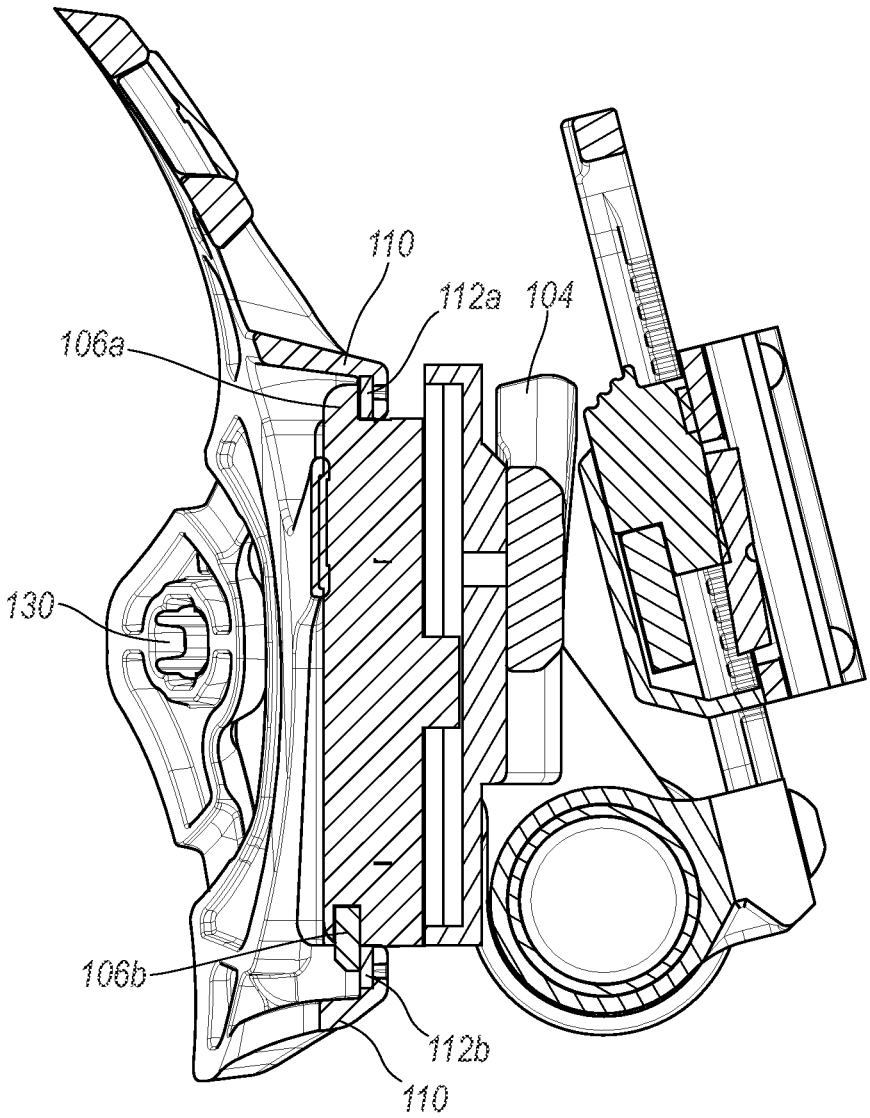
FIG. 14 is a side cutaway view of the shroud assembly and attached accessory mount taken along lines 14-14 shown in FIG. 13.

The interface 108 of the shroud assembly 100 includes retention features, such as an upper recess 116 and a lower recess 118, for removably engaging latch members (106*a*, 106*b*) found on a suitably configured accessory mount 104 (e.g., a G24 mount). Each recess 116, 118 is formed by an overhang 120, 122. Each overhang 120, 122 is a portion of the insert 112 that is partially overmolded by the frame 110. More particularly, each overhang 120, 122 includes an interior facing sidewall 124, 126 that is an exposed portion (i.e., not covered by the polymer frame 110) of the upper crossmember 112*a* or bottom crossmember 112*b* of the metal insert 112 (see, e.g., FIG. 5). In this way, the interface 108 serves as a rigid attachment point for the selected accessory mount 104. In the preferred embodiment, the interior facing sidewall 124, 126 of each overhang 120, 122 is configured to act as a bearing surface for an engaging latch member (106*a*, 106*b*) of the selected accessory mount 104 (see, e.g., FIGS. 12 and 13).

The interface 108 of the shroud assembly 100 also includes a pair of lateral sidewalls 132 on opposite lateral sides thereof. The lateral sidewalls 132 are an integral portion of the frame 110 and are spaced apart a distance that provides a snug, interference fit between the lateral sidewalls 132 and the sides of an attached accessory mount 104. In this way, axial rotation of the attached accessory mount 104 is minimized or prevented.

The foregoing description of the invention is intended to be illustrative; it is not intended to be exhaustive or to limit the claims to the precise forms disclosed. Those skilled in the relevant art can appreciate that many modifications and variations are possible in light of the foregoing description and associated drawings.

Reference throughout this specification to an "embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

The invention claimed is:

1. A shroud assembly comprising:

a polymer frame; and an insert formed of a metal or metal alloy;

wherein:

the polymer frame is overmolded onto the insert such that the polymer frame and the insert cooperate to form an interface for the removable attachment of an accessory mount;

the interface includes an upper recess and a lower recess;

the upper recess is configured to act as a bearing surface for an engaging latch member of the accessory mount; and the lower recess is configured to act as a bearing surface for another engaging latch member of the accessory mount.

2. The shroud assembly of claim 1, wherein the interface includes a first sidewall and a second sidewall that define opposite sides of the interface, the first and second sidewalls are spaced a sufficient distance apart to provide an interference fit between the accessory mount and the first and second sidewalls.

3. The shroud assembly of claim 2, wherein the first and second sidewalls extend vertically and are positioned between the upper recess and the lower recess.

4. The shroud assembly of claim 1, wherein the insert comprises a top crossmember and a bottom crossmember.

5. The shroud assembly of claim 4, wherein the top crossmember and the bottom crossmember are horizontally oriented and structurally connected by a pair of vertically aligned side posts, collectively delineating the boundaries of a central opening.

6. A shroud assembly comprising:

a polymer frame; and an insert formed of a metal or metal alloy;

wherein:

the polymer frame is overmolded onto the insert;

the polymer frame and the insert cooperate to form an interface for the removable attachment of an accessory mount;

the interface includes an upper recess and a lower recess; and the upper recess and the lower recess each include an interior-facing sidewall that is an exposed portion of the insert not covered by the polymer frame.

7. The shroud assembly of claim 6, wherein the interior-facing sidewall of the upper recess is configured to act as a bearing surface for an engaging latch member of the accessory mount, and the interior-facing sidewall of the lower recess is configured to act as a bearing surface for another engaging latch member of the accessory mount.

8. The shroud assembly of claim 7, wherein the interface includes a first sidewall and a second sidewall that define opposite sides of the interface, the first and second sidewalls are spaced a sufficient distance apart to provide an interference fit between the accessory mount and the first and second sidewalls.

9. The shroud assembly of claim 8, wherein the first and second sidewalls extend vertically and are positioned between the upper recess and the lower recess.

10. The shroud assembly of claim 6, wherein the insert comprises a top crossmember and a bottom crossmember.

11. The shroud assembly of claim 10, wherein the interior-facing sidewall of the upper recess is a portion of the top crossmember, and the interior-facing sidewall of the lower recess is a portion of the bottom crossmember.

12. The shroud assembly of claim 11, wherein the top crossmember and the bottom crossmember are horizontally oriented and structurally connected by a pair of vertically aligned side posts, collectively delineating the boundaries of a central opening.

13. A shroud assembly comprising:

a metal alloy insert; and a polymer frame overmolded onto the insert;

an accessory mount interface formed by the metal alloy insert and the polymer frame, the accessory mount interface comprising:

an upper recess in which a first interior-facing sidewall of the metal alloy insert is exposed; and a lower recess in which a second interior-facing sidewall of the metal alloy insert is exposed.

14. The shroud assembly of claim 13, wherein the metal alloy insert comprises a top crossmember and a bottom crossmember, connected to each other by a first side post and a second side post, and further wherein the top and bottom crossmembers are offset from the first and second side posts.

15. The shroud assembly of claim 14, wherein the first interior-facing sidewall is a portion of the top crossmember, and the second interior-facing sidewall is a portion of the bottom crossmember.

16. The shroud assembly of claim 14, wherein the top crossmember, the bottom crossmember, the first side post, and the second side post substantially delineate a boundary of a central opening.

17. The shroud assembly of claim 16, wherein polymer frame comprises a bridge that extends across the central opening from the first side post to the second side post.

18. The shroud assembly of claim 13, wherein the metal alloy insert stiffens the polymer frame around the accessory mount interface.

19. The shroud assembly of claim 13, wherein the polymer frame comprises a generally concave back surface.

20. The shroud assembly of claim 13, wherein the polymer frame further comprises a back surface, the back surface comprising a plurality of cavities.

* * * * *